US006546867B1

(12) United States Patent
Franklin et al.

(10) Patent No.: US 6,546,867 B1
(45) Date of Patent: Apr. 15, 2003

(54) VARIABLE-DIAMETER CYLINDRICALLY-SHAPED BODY

(75) Inventors: Stephen Franklin, Barrington, NH (US); Robert Richard Murray, Madbury, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 12 days.

(21) Appl. No.: 09/845,556

(22) Filed: Apr. 30, 2001

(51) Int. Cl.[7] ..... B41F 13/08; B41F 13/193; B41F 13/10

(52) U.S. Cl. ..... 101/378; 101/483; 492/21

(58) Field of Search ..... 101/378, 475, 101/483; 242/573.1; 492/21; 72/478

(56) References Cited

U.S. PATENT DOCUMENTS

| | | | | | |
|---|---|---|---|---|---|
| 180,169 | A | * | 7/1876 | Tasker | 242/573.1 |
| 598,107 | A | * | 2/1898 | Moody | 226/175 |
| 763,251 | A | * | 6/1904 | Breck | 101/375 |
| 4,441,426 | A | * | 4/1984 | Lajovic | 101/218 |
| 5,711,222 | A | * | 1/1998 | Taylor et al. | 101/383 |
| 6,110,093 | A | | 8/2000 | Slusarz | 493/416 |

FOREIGN PATENT DOCUMENTS

| | | | | |
|---|---|---|---|---|
| DE | 1097452 A | * | 1/1961 | |
| DE | 19649324 C2 | * | 9/1998 | B41F/13/08 |

* cited by examiner

*Primary Examiner*—Daniel J. Colilla
(74) *Attorney, Agent, or Firm*—Davidson, Davidson & Kappel, LLC

(57) ABSTRACT

A variable-diameter cylindrically-shaped body includes a plurality of first tapered elements and a plurality of second tapered elements interacting with the first tapered elements and movable axially with respect to the first tapered elements. The first and second tapered elements define an outer surface of the body, with the outer surface having an effective diameter variable as a function of axial movement between the first and second tapered elements. The body has particular applicability in printing presses.

24 Claims, 8 Drawing Sheets

122
22b
22c
30
10
22a
12b
12a
22g
12g
22f
112
12f
22e
12e
12d
22d
12c

VARIABLE-DIAMETER CYLINDRICALLY-SHAPED BODY

BACKGROUND OF THE INVENTION

The present invention relates to cylindrically-shaped bodies with a variable diameter.

Various types of cylinders, for example, are used in a printing press, including ink rolls, plate cylinders, blanket cylinders, and web-guiding cylinders.

German Patent No. 196 49 324 C2 for example purports to disclose a changeable-circumference rotating body for rotary printing presses having a shaft (element four) on which a cylinder-like support element (element eleven) for changing the circumference is supported. A cylindrical screw spring (element twelve) connected at one side directly or indirectly to the shaft is located about the support element. At the other side of the screw spring is a device for relative movement of the coils of the spring in the axial direction, in order to selectively change the diameter of the screw spring. The cylinder can be used as a blanket cylinder, a redirecting cylinder for a web with a suitable diameter for different paper thicknesses, or a flat drive belt roll to change the rotational rate of a drive.

Underneath the screw spring, springs (elements thirty-six and thirty-seven) force segments (identified by numbers thirty-one through thirty-four) against the truncated-cone-shaped rotating element. Axial movement of the rotating in direction F changes the diameter by moving the segments in direction A. Spaces still result in the outer circumference of both the screw spring and between the elements.

German Patent No. 1 097 452 purports to disclose a printing cylinder formed of a conically-shaped carrier cylinder (element twenty) and an inner-conical separable sleeve (element nineteen) for a rotary printing press with two interacting cylinders (elements eleven and twelve). A pressurized fluid in a screw-shaped groove (element twenty-five) acts to expand the sleeve to expand the sleeve for removal or to permit the sleeve pushed onto the carrier cylinder. The sleeve sits with a press fit on the carrier cylinder when pressure is not provided. The fluid pressure system is complicated and no device for axial movement is disclosed.

In printing presses where two cylinders in frictional contact with each other are driven by independent motors, it can be a problem that one motor operates at full torque and the other motor acts as a less than desirable torque or even as a brake. This unbalance is due to the fact that minor diameter differences between the cylinders can cause one cylinder to transmit torque to the other through the frictional contact.

BRIEF SUMMARY OF THE INVENTION

An object of the present invention is to provide a variable-diameter cylindrically-shaped body in which the effective diameter can be easily changed. Another alternate or additional object is to provide better torque control for printing press cylindrical bodies. Yet another alternate or addition object is to provide for a cylindrical body with a solid outer surface with an easily-changeable diameter.

Commonly-assigned U.S. Pat. No. 6,110,092 discloses a roller having mantel with a pattern of openings for permitting a variable diameter. Inclined portions of the mantle interact with sliding portions to change the diameter. Openings are present on the outer surface. No tapered elements are disclosed.

The present invention provides a variable-diameter cylindrically-shaped body comprising a plurality of first tapered elements, and a plurality of second tapered elements interacting with the first tapered elements and movable axially with respect to the first tapered elements, the first and second tapered elements defining an outer surface of the body. The outer surface has an effective diameter variable as a function of axial movement between the first and second tapered elements.

Cylindrically-shaped as defined herein is a generally cylindrical outer surface, but need not be perfectly cylindrical. Preferably, a diameter of the outer surface does not vary by more than 10% from the minimum outer surface diameter.

Preferably, the first and second tapered elements are constructed so that as the tapered elements move with respect to each other the varying effective diameter of the cylindrical body is the same over the entire width of the cylindrical body. A rosette pattern may be formed when the tapered elements move away from a zero position.

Most preferably, contacting edges of the first and second tapered elements are such that the edges are in contact over their contacting surface for every diameter change caused by sliding movement of the tapered elements.

Preferably, the body is a rotating body, and most preferably a rotating body in a printing press.

Through use of the interacting first and second tapered elements, the effective diameter (the maximum diameter) can be changed easily, and an outer surface without openings can be provided.

The cylindrical body preferably is attached to a torque controller so as to alter or control the torque of a motor driving the body by altering the body diameter. The cylindrical body of the present invention can be, for example, provided in a press as a plate cylinder and a blanket cylinder, each with a variable diameter and driven independently by an individual motor. Varying the diameter of the plate and blanket cylinders can alter the torque experienced by the motors driving the two rollers so as to properly split the torque between the two motors. This configuration can aid in solving the torque-splitting problem present in presses where contacting cylinders are driven by independent motors.

The outer surface of the cylindrical body preferably has no openings, so that the body may be used, for example, as an ink form cylinder which can carry ink directly on its outer surface.

The cylindrical body alternatively may be used as a blanket, plate or other press cylinder, which can expand its diameter to permit easy removal and to firmly hold a tubular-shaped blanket, plate or other printing form sleeve at the outer surface.

The cylindrical body may have an outer slot, and a flat plate, flat blanket or other element may be wrapped around an inserted at both ends into the slot. The effective diameter may then be expanded to firmly hold the flat printing form.

The cylindrical body may also be used for contacting a web or signatures either directly or through an elastic element, such as a blanket. As such the body can act as a variable radius contact driven roll or driving roll having fine adjustment of a rotational speed or for varying a cut-off length. Moreover, tension in the web can be controlled in an out-feed or in-feed or in a span between two nips. The speed of the top and bottom web in a multi-web package also could be controlled.

When used for transferring fluids such as ink or wetting solution, the delivery of the fluid amount can be altered by changing the diameter.

Also, the variable diameter can cause the cylindrical body to move into or out of contact with another object, such as another cylinder, or can alter the contact pressure between the cylindrical body and another object.

The cylindrical body can be controlled by a controller controlling a diameter setting device, which moves the first tapered elements axially with respect to the second tapered elements. The setting device for one set of tapered elements may include a motor with a shaft having interior threading, and a second shaft with interior threading fixedly connected to the tapered elements. A clutch may be provided to permit the two shafts to rotate together when engaged, or to permit a setting operation when disengaged.

The present invention also provides a printing press comprising a first variable-diameter cylindrical body including first and second tapered elements facing each other.

Preferably, the press includes a second cylindrical body forming a nip with the first cylindrical body, a first motor for driving the first cylinder, a second motor for driving the second cylinder, and a torque controller for distributing torque between the first and second motors as a function of a diameter of the variable-diameter cylinder.

The first and second tapered elements preferably are constructed so that as the tapered elements move with respect to each other, an effective diameter of the cylindrical body remains similar over the entire width of the cylindrical body. A rosette pattern may be formed when the tapered elements move away from a zero position.

The first cylindrical body preferably is a form roll, plate cylinder or blanket cylinder of an offset lithographic printing press.

Preferably both the first and second cylindrical bodies have variable diameters.

The variable-diameter cylindrical body can also be used for lateral register control of a web by moving the first and second tapered elements in a same direction without altering the diameter.

The present invention also provides a method for altering a printing press rotating body effective diameter including the steps of varying an effective diameter of a cylindrical body by moving a plurality of first tapered elements axially between interacting second tapered elements, the first and second tapered elements defining an outer surface of the body.

The method may further include altering a torque of a drive motor for the cylinder by varying the diameter.

The method also may include altering ink or wetting solution delivery as a function of the diameter.

The method also may include securing a printing form, such as a blanket or plate, to the cylindrical body by altering the cylindrical body effective diameter.

In addition, the method may include controlling microslip in a nip, or controlling the speed of a web, the tension in a span between two nips, the tension in an out-feed or the tension in an infeed.

The method also may be used to move the cylinder into or out of contact with another roll or object or to adjust the contact pressure between the cylinder and another object.

Rather than changing the diameter, if each of the first and second tapered elements are independently driven, the method also could include moving the cylindrical body laterally by moving the first and second elements in a similar direction.

"Printing form" as defined herein can be any element covering a printing press cylinder, including a blanket, plate, or roll covering.

BRIEF DESCRIPTION OF THE DRAWINGS

A preferred embodiment of the present invention is described below by reference to the following drawings, in which.

DETAILED DESCRIPTION

Figure 1:
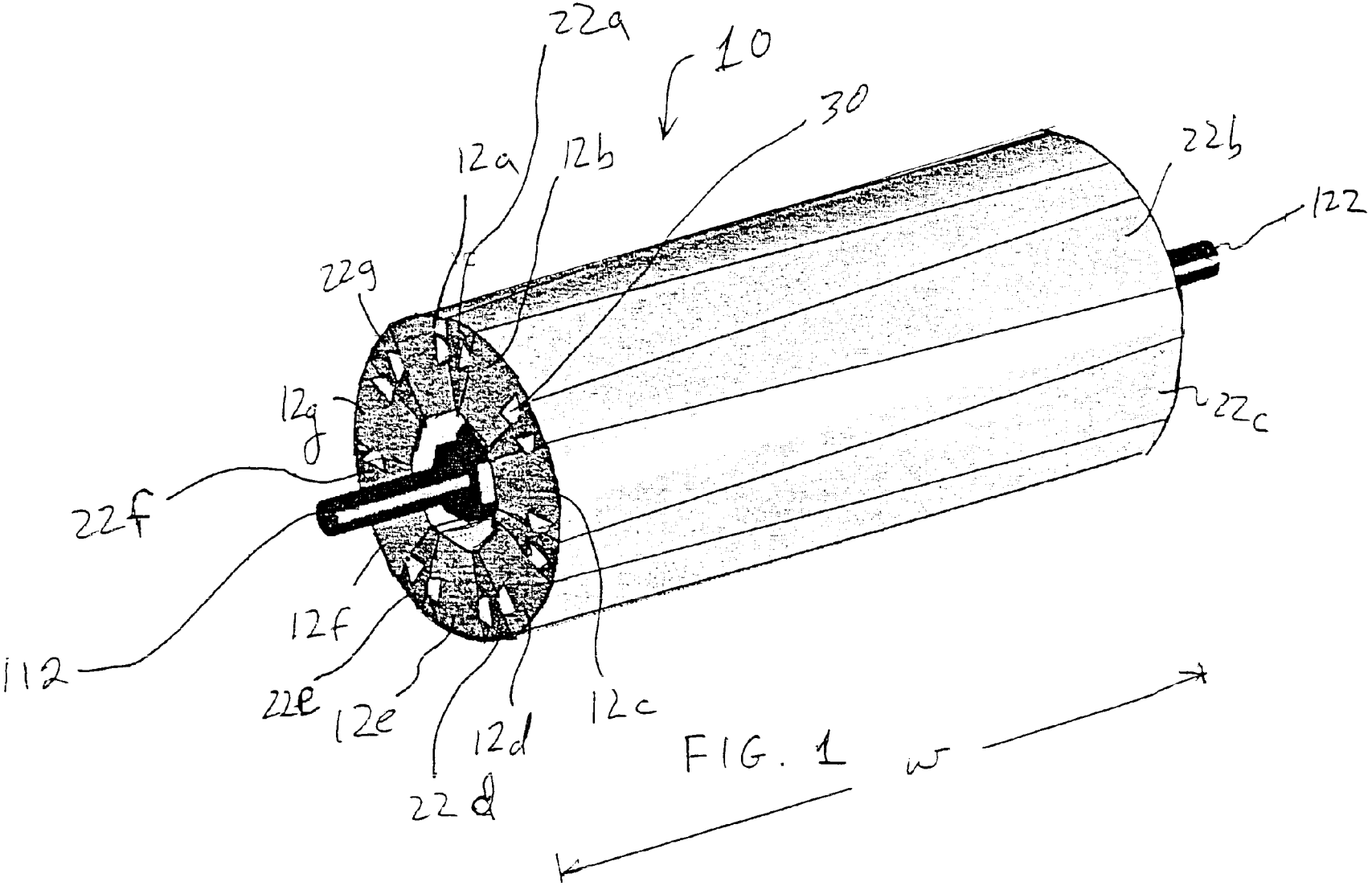
FIG. 1 shows a perspective view of an embodiment of the cylindrical body of the present invention having seven first tapered elements and seven second tapered elements in a first position, also defined as the zero position.
Figure 4:
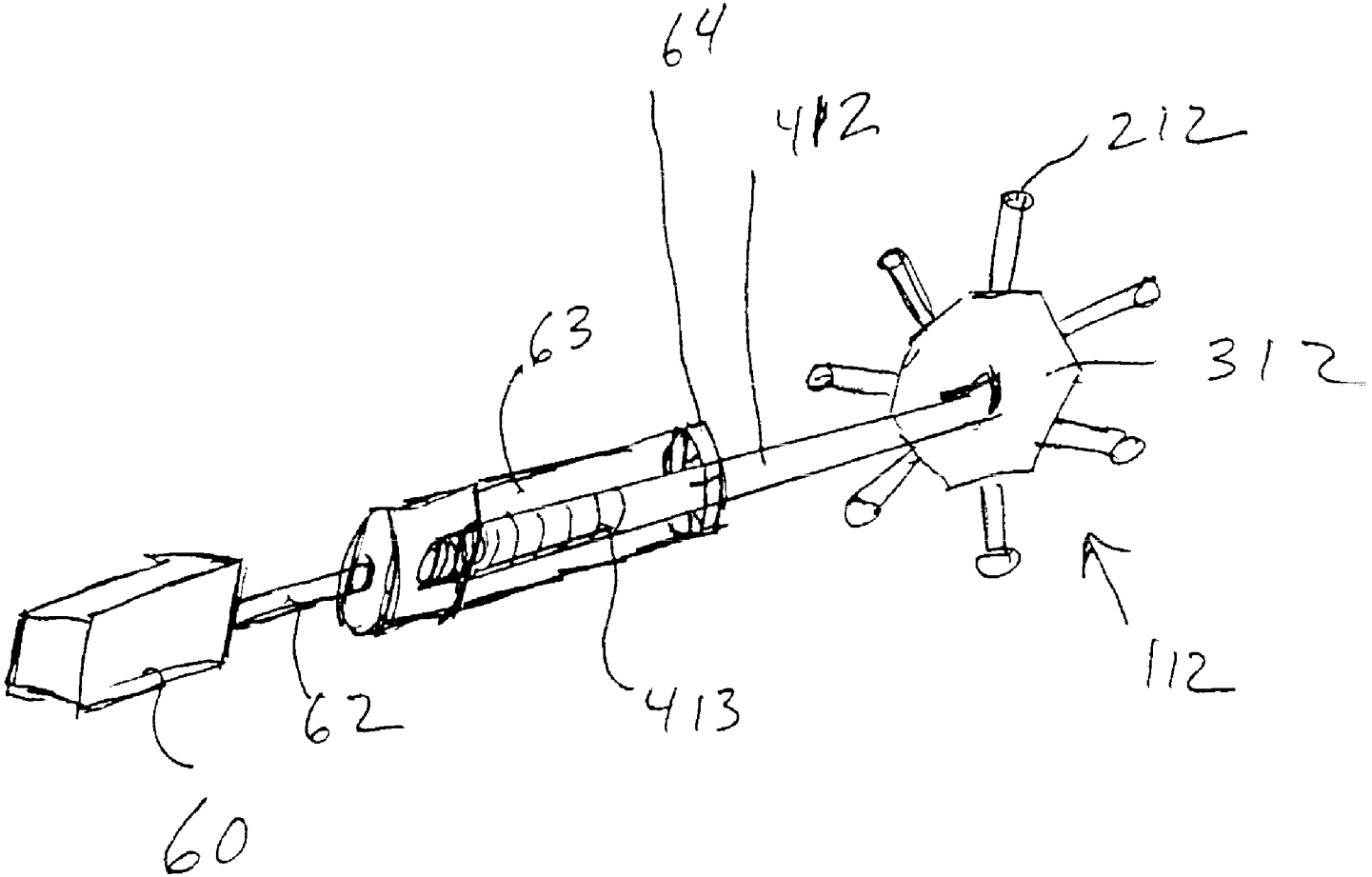
FIG. 4 shows one possible embodiment of one of the actuators for the cylindrical body of FIG. 1.

FIG. 1 shows a cylindrical body 10 with a width w having first tapered elements 12*a,* 12*b,* 12*c,* 12*d,* 12*e,* 12*f* and 12*g,* and second tapered elements 22*a,* 22*b,* 22*c,* 22*d,* 22*e,* 22*f,* and 22*g*. First tapered elements 12*a,* 12*b,* 12*c,* 12*d,* 12*e,* 12*f* and 12*g* are each connected at their interior surfaces to a first common actuator 112, which has seven arms fixedly attaching each of the first tapered elements in an axial direction, but permitting a radial change. Second tapered elements 22*a,* 22*b,* 22*c,* 22*d,* 22*e,* 22*f,* and 22*g* likewise are attached to a second common actuator 122. The first and second tapered elements connect to each other so as to be able to slide with respect to each other, for example by dovetail joints 30. FIG. 4 shows one possible embodiment for the actuator 112 schematically in more detail. The arms 212 of actuator 112 are fixedly connected to the first tapered elements. The arms 212 are also fixedly connected to a plate 312 fixedly connected to a shaft 412. Shaft 412 has external threading 413 at on end. Actuator 112 also includes a drive motor 60 with a drive shaft 62. Drive shaft 62 is connected to an interior threading section 63 which has interior threads interacting with threads 413 of shaft 412. At the end of section 63 is a clutch 64 for selectively clutching shaft 62 to shaft 412. When cylindrical body 10 of FIG. 1 is to be driven, clutch 64 is engaged so that shafts 62 and 412 rotate together. Motor 62 preferably is stationary, so that when clutch 64 is disengaged and motor 60 is driven, shaft 62 through interior threading section 63 causes exterior threading 413 to pull or push shaft 412, plate 312 and arms 212 away from or towards the motor 60.

Actuator 212 for the second tapered elements may have the mirrored structure of actuator 112. Actuator 212 also may be stationary in an axial direction with no motor, in which case only the first tapered elements move axially.

Thus actuator 112, when clutch 64 is disengaged, may operate through motor 60 to move the first tapered elements axially. When the clutch 64 is engaged the entire cylinder can be driven the motor 60, or if a motor is attached to the second actuator 212, by both motors.

Other actuators are also possible. However, they must permit rotation of the first and second tapered elements together during an operational mode and axial movement of the first tapered elements with respect to the second tapered elements during a cylinder setting mode.

Figure 2:
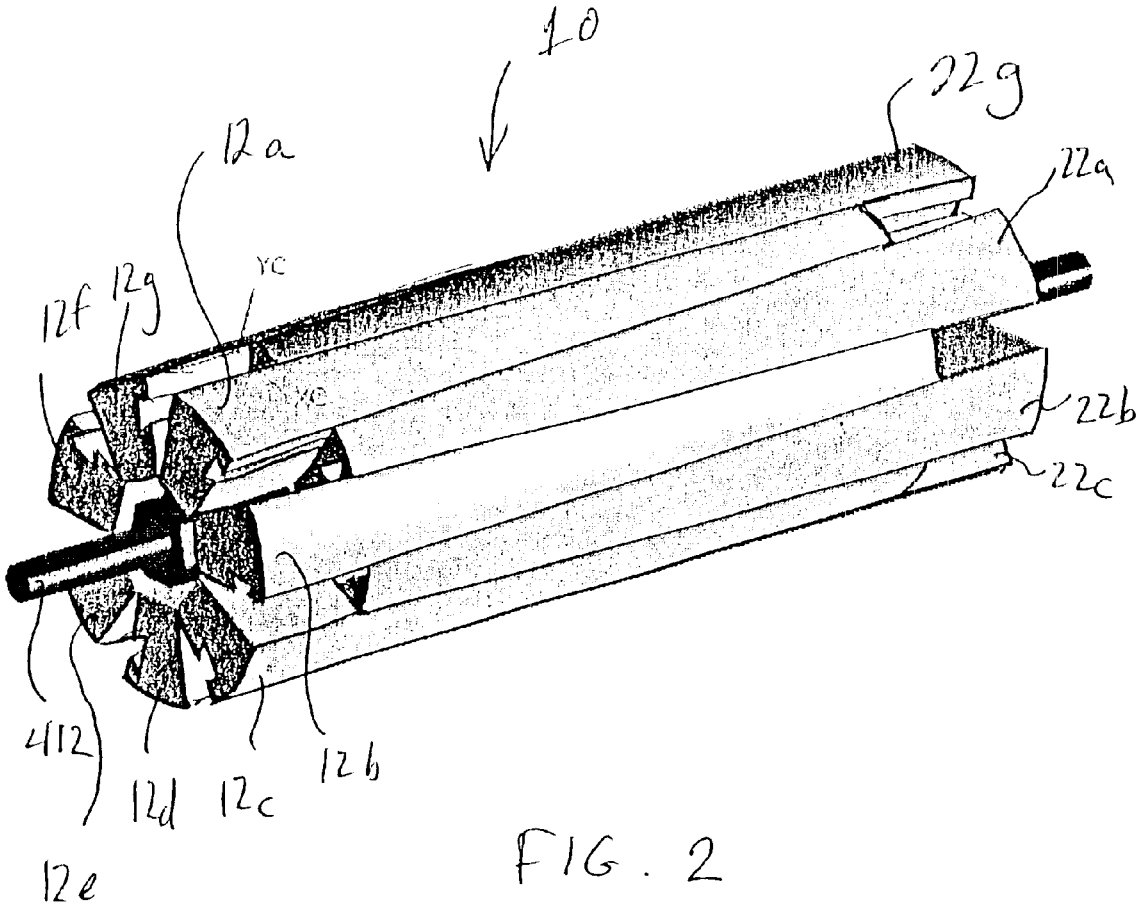
FIG. 2 shows a perspective view of the FIG. 1 embodiment with the effective diameter being smaller than the diameter in the first position, the first and second elements having been moved away from each other.

FIG. 2 shows the cylindrical body 10 of FIG. 1 with shaft 412 and first tapered elements 12*a*, 12*b*, 12*c*, 12*d*, 12*e*, 12*f* and 12*g* slid away from the second tapered elements. The effective circumference slightly decreases, and thus the diameter slightly decreases, depending on the angle of the taper and the distance moved. Very fine diameter adjustments, on the order for example of 1% or less, can be performed. The effective width decreases.

Figure 3:
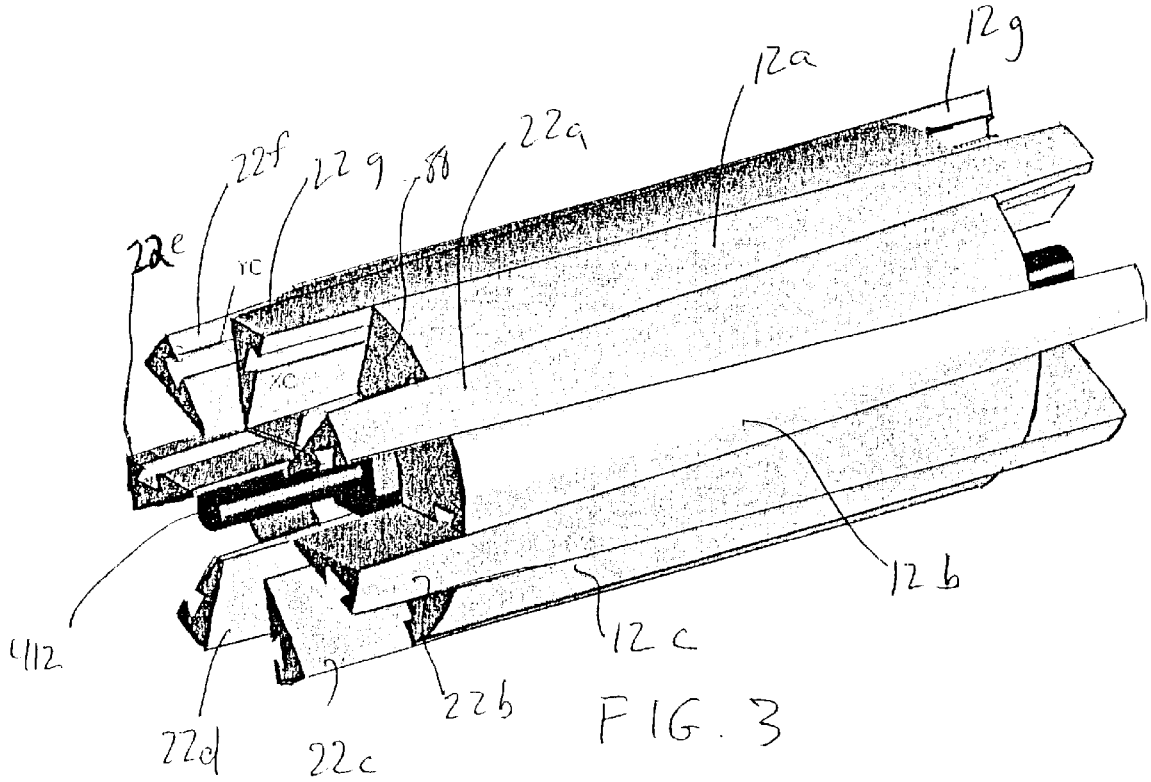
FIG. 3 shows a perspective view of the FIG. 1 embodiment with the effective diameter being greater than the diameter in the first position, the first and second tapered elements having been moved towards each other.

FIG. 3 shows the cylinder 10 of FIG. 1 with shaft 412 and first tapered elements slid towards the second tapered elements 22*a*, 22*b*, 22*c*, 22*d*, 22*e*, 22*f* and 22*g*. The effective circumference of cylinder 10 slightly increases, and thus the effective diameter slightly increases. The effective width decreases. Element 12*a* has an end 88.

The cylinder may have any number of first tapered elements, preferably an odd number and most preferably 3, 5, 7 or 9. The same number of second tapered elements may be provided.

A preferred taper of the elements can be determined by drawing a line with a length L representing an axis. L is chosen to be equal to or preferably greater than width of the cylinder to be constructed. A plane is drawn perpendicular to the line at one end. A circle is drawn in the plane, with the axis being the center of the circle. An odd number of points n representing the desired number of first tapered elements are spaced equally about the circle. From any point on the first circle, lines 11 and 12 are drawn to the two points on the same circle that are farthest away. The two planes created through 11 and the midpoint of the line L, and through 12 and the midpoint of the line L define the sides of one tapered element, although the ends of the tapered element may be cut off. For example, L may be chosen to be three times the actual width of the cylinder, so that two-thirds is cut-off. A number of tapered elements equal to 2n are be manufactured and placed together in a sliding fashion, for example with dovetail joints, to form the cylinder.

The length L can be chosen based on design considerations, for example, how much diameter change is desired and based on the desired width of the cylinder. The contacting surfaces of the tapered elements preferably slide with respect to one another so that the entire surfaces over the effective width always remain in contact. It is noted that with the preferred construction, a slight rosette may form when the first and second tapered elements are moved with respect to each other to increase or decrease the diameter. However, this rosette pattern may remain minor and typically will not affect print quality in a press, and will be explained by reference to FIGS. 6 and 7.

Figure 6:
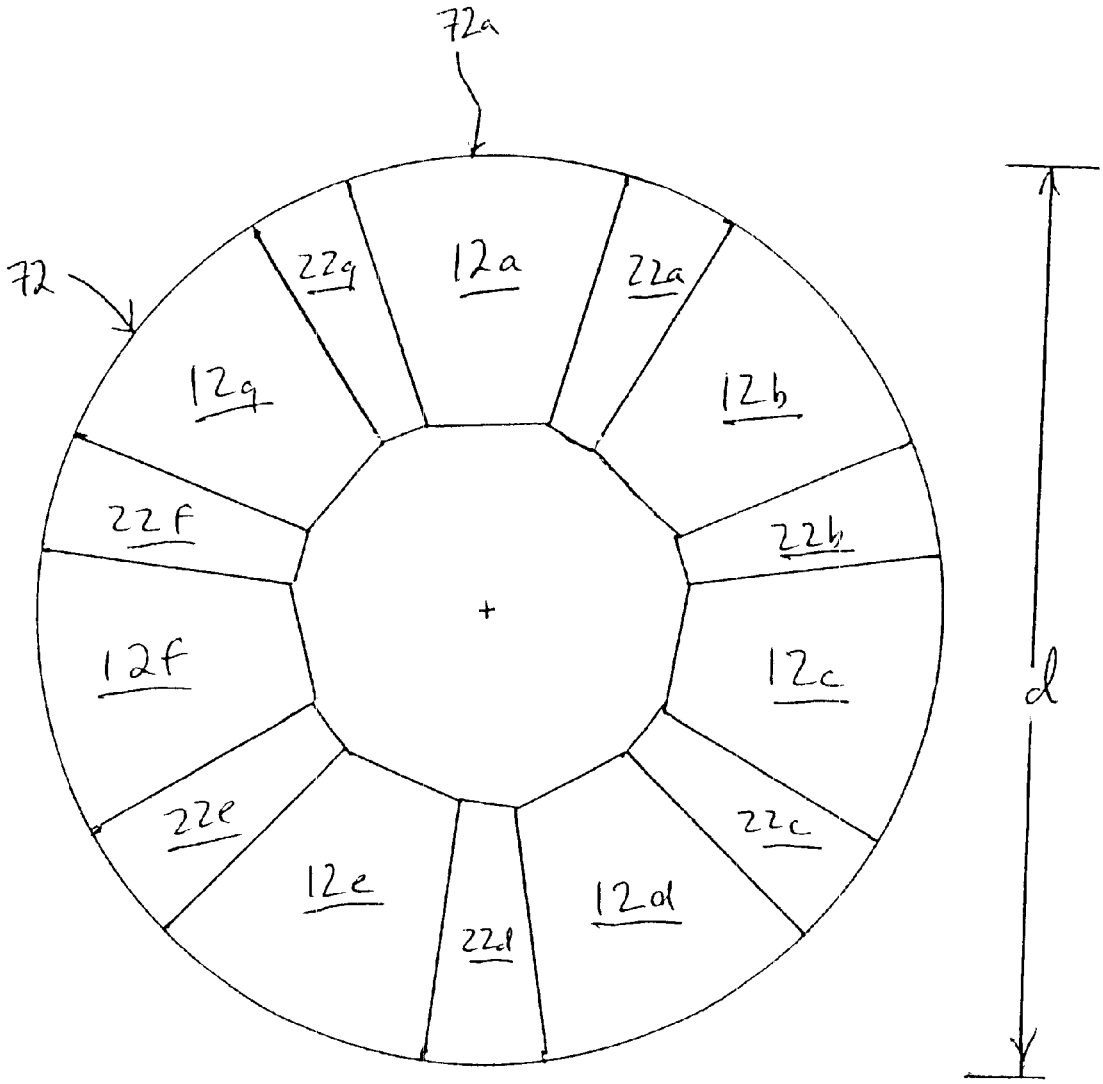
FIG. 6 shows schematically an end view of the cylindrical body of FIG. 1 in the zero position.

FIG. 6 shows the end of cylindrical body 10 of FIG. 1 in the zero position, with an effective diameter d. In the zero position, the outer surface 72 formed by the outer surface of the elements 12*a*, 22*a*, 12*b*, 22*b*, etc. preferably is perfectly cylindrical. The outer surface arc 72*a* formed by element 12*a* and the outer surface 72 thus have the same curvature.

Figure 7:
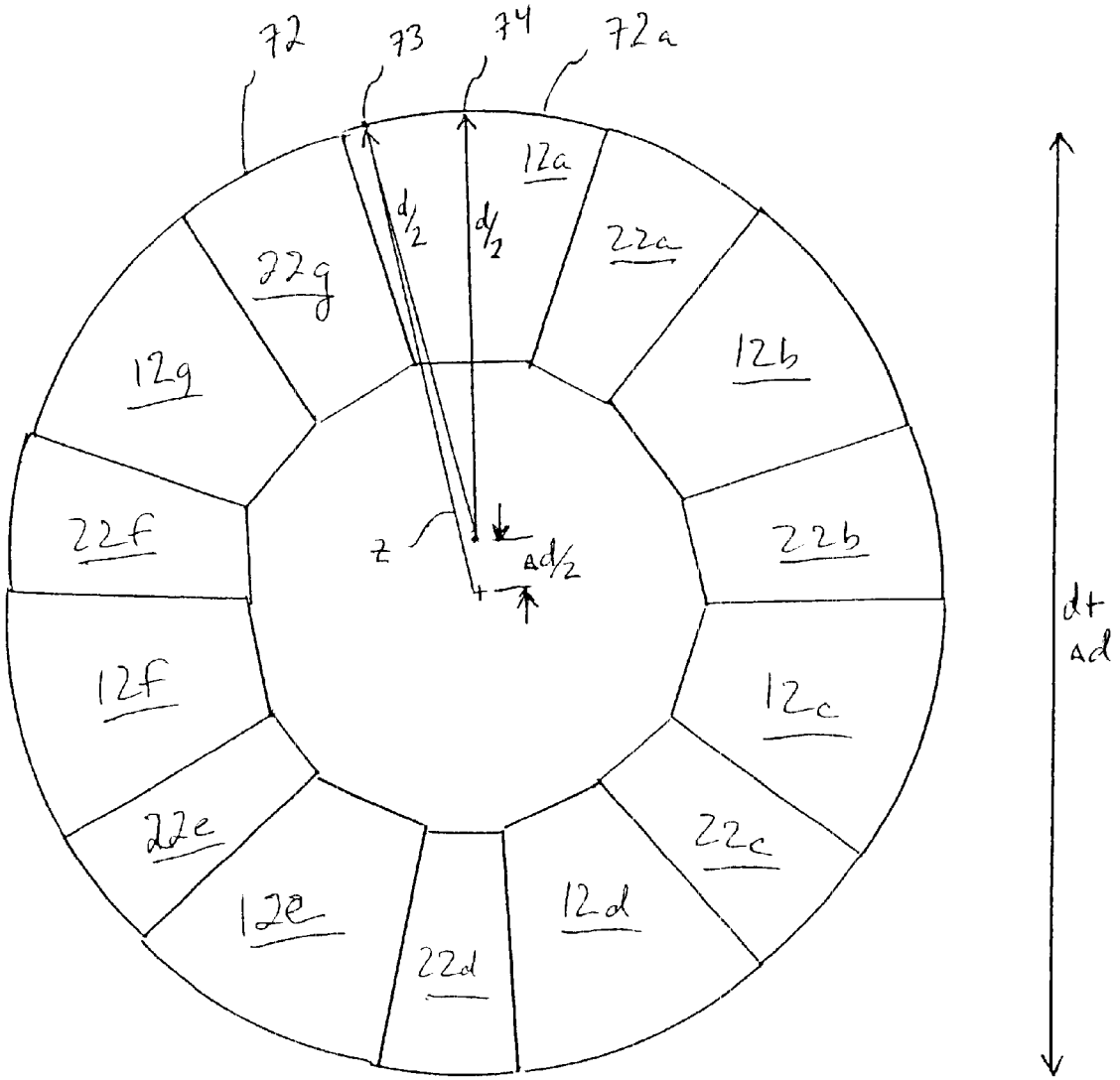
FIG. 7 shows schematically the cylindrical body at the plane formed by the ends of bodies 12*a,* 12*b,* etc.

FIG. 7 shows the plane of cylindrical body 10 of FIG. 3 at the plane of end 88. The elements 12*a*, 12*b*, 12*c*, etc. have been forced outwardly by the elements coming together, so that the effective diameter has increased to d+Δd. The rosette pattern can now be understood, as the curvature of arc 72*a* now differs from that of the outer surface 72. The effective diameter is created by the midpoints 74 of the elements 12*a*, 22*a*, 12*b*, 22*b*, etc., as these points are the furthest from the center of the body 10. Points 73 away from the midpoints are at a slightly smaller distance z from the center of the body 10, as can be recognized by the fact that z is shorter than (d+Δd)/2. However, the outer surface remains generally cylindrical and remains effective for almost all applications in a printing press.

The tapered elements are constructed so that the effective diameter, as it varies, remains the same over the entire effective width of the body.

Figure 5:
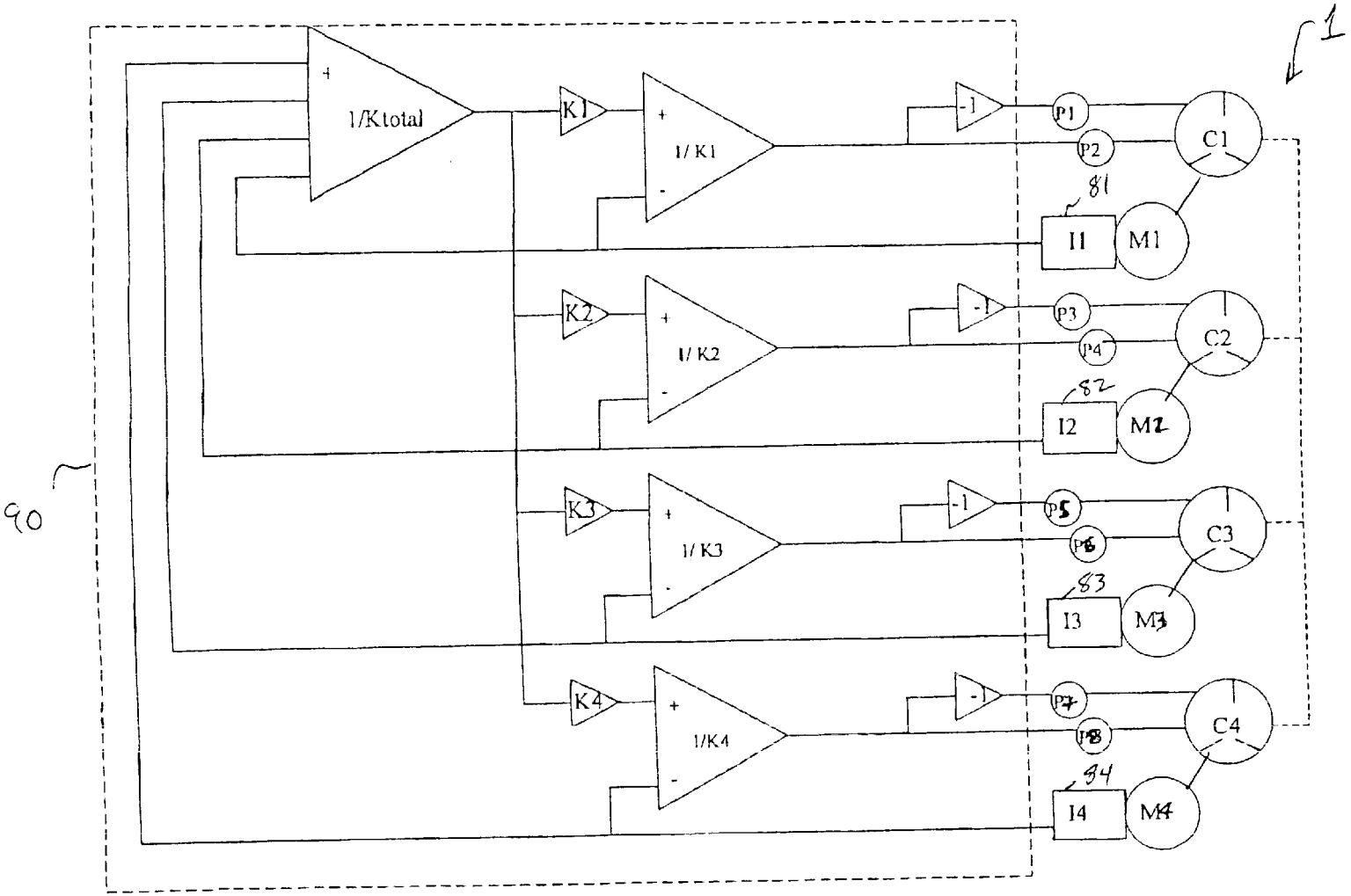
FIG. 5 shows a preferred embodiment of a controller for a four-cylinder configuration where each cylindrical body has a variable diameter according to the present invention.

FIG. 5 shows schematically an embodiment of a printing unit of printing press 1. A first plate cylinder C1 is in operable contact at a nip with a first blanket cylinder C2, which forms a nip with second blanket cylinder C3. A web runs through the nip. A second plate cylinder C4 is in operable contact with second blanket cylinder C4. Each cylinder C1, C2, C3, C4 is driven independently via motors M1, M2, M3, M4, respectively. Each of the motors has a nameplate power rating K1, K2, K3, K4, respectively, with Ktotal being the sum of the power ratings. Each of the cylinders C1, C2, C3, C4 has a variable diameter, preferably using tapered elements similar to the cylinder 100 of FIG. 1, but with two position controllers on each end.

Motor controllers 81, 82, 83, 84 supply motor torque current I1, I2, I3, I4 respectively to motors M1, M2, M3, M4. Position controllers and position P1, P2 control the position of work side and gear side diameter setting devices, respectively, for moving the tapered elements of cylinder C1 together or apart. Position controllers P3, P4 control work and gear side diameter setting devices of cylinder C2, position controllers P5, P6 the work and gear side diameter setting devices of cylinder C3 and position controllers P7, P8 the work and gear side diameter setting devices of cylinder C4. The positions P1, P2, P3, P4, P5, P6, P7, P8 are controlled by a controller 90 to adjust the diameter setting devices as follows: P1=−Itotal/Ktotal+I1/K1; P2=Itotal/Ktotal−I1/K1; P3=−Itotal/Ktotal+I2/K2; P4=Itotal/Ktotal−I2/K2; P5=−Itotal/Ktotal+I3/K3; P6=Itotal/Ktotal−I3/K3; P7=−Itotal/Ktotal+I4/K4; and P8=Itotal/Ktotal−I4/K4. Itotal equals the sum of I1, I2, I3 and I4. A positive number on the work side (P1, P3, P5 or P7) indicates a reduction in diameter and a pulling apart, while a positive number on the gear side (P2, P4, P6, P8) indicates an increase in diameter and a pushing together of the tapered elements.

The power distribution can occur, for example, during start-up or at a very slow band width control after several second of obtaining data.

Thus, as a simple hypothetical example, M1, M2, M3 and M4 all have the same power rating and M1 is driving all of the cylinders because the nip between C1 and C2 is so strong that no or minimal torque current is registered at I2, I3, I4. According to the controller 90, P1 would be set to equal −I1/Ktotal+I1/K1 resulting in a positive number, and P2 the negative of this amount. The cylinder C1 diameter would decrease. P3, P5 and P7 would be set to −I1/Ktotal, and P4, P6, P8 to I1/Ktotal, thus the cylinder diameters would increase. The torque thus would be spread more evenly between the motors, as the nip pressure between cylinders C1 and C2 would decrease.

More particularly, since the motors all have the same power ratings K1=K2=K3=K4 and Ktotal=4K1 and the currents I2=I3=I4=0 then when the scale factor between the position and the torque or current is 1, the values calculated for P1–P8 represent offsetting values to be added to the position values to achieve the same current in all motors. P1 would be offset to equal −¼I1/K1+I1/K1 or ¾I1/K1 and P2 to the negative of this amount. P3, P5 and P7 would be offset to −¼I1/K1 and P2,P4,P6 to the negative of this amount. If I1 was at its maximum name plate reading then I1/K1=100%. Then the values to be added are P1=75%, P2=−75% P3, P5, P7=−25% and P2, P4, P6=25% This means that what ever the positive decrease in roll C1's diameter is the increase in C1, C3, C4 should be 3 times that to achieve balance.

If the motors all have the same nameplate rating, and the motor currents I1, I2, I3, I4 are equal, as desired, no position change is required.

A feedback loop also could be provided to alter the diameter in an iterative process, for example, to attempt to equalize the torque currents I1, I2, I3, I4 for similarly rated motors.

With the embodiment of FIG. 5, it is also noted that the lateral register of the plates could be adjusted by moving both the first and second tapered elements of a cylinder in a similar direction, while keeping the diameter the same.

Figure 8:
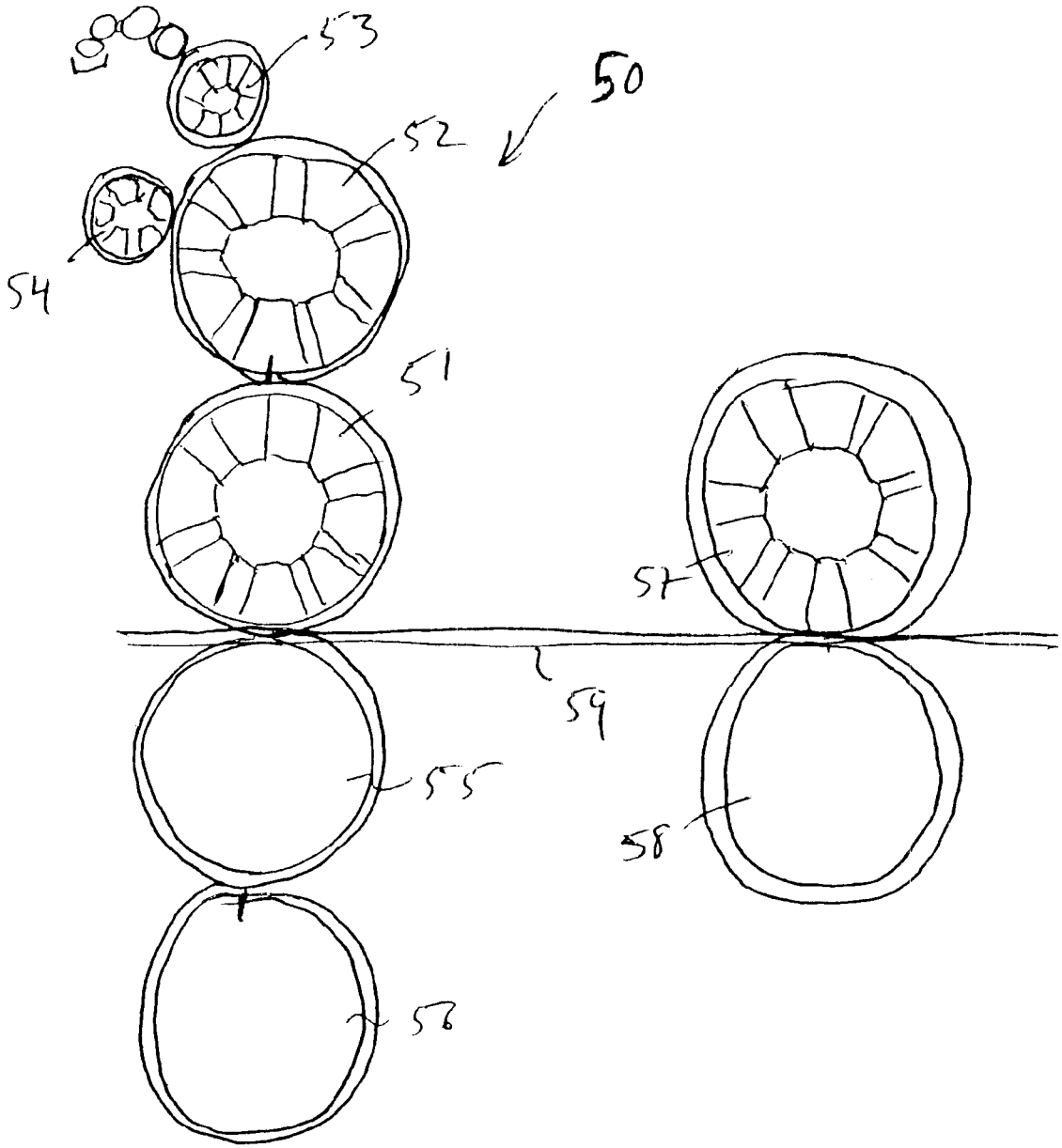
FIG. 8 shows various uses of the cylindrical body in a printing press.

FIG. 8 shows an offset lithographic printing press 50 with a blanket cylinder 51, plate cylinder 52, ink form roll 53, and wetting roll 54. Blanket cylinder 51 may have an axially-removable blanket attachable thereto through expanding the diameter. Such a blanket is described for example in U.S. Pat. No. 5,813,336, which is hereby incorporated by reference herein. The plate cylinder 52 may attach a flat printing plate that extends at both ends into an axially-extending slot in the cylinder 52, which is then expanded. Alternately a sleeve-shaped printing plate may be attached, or the cylinder may be directly imageable on an outer surface.

Rolls 53 and 54 may have an outer rubber coating, or may be uncoated. By varying the diameter of the rolls, delivery of ink and wetting solution can be altered, and the rolls 53, 54 can be moved out of contact with the plate.

Press 50 also has a second blanket cylinder 55 and plate cylinder 56, which may be similar to cylinders 51 and 52, respectively. A web 59, which may be a layered multi-web package, passes through a nip formed between blanket cylinders 51 and 55. The web may pass to a second nip formed between cylindrical bodies 57, 58 which may for example be blanket cylinders of a second printing unit. The tension in the web between the two nips can be controlled by altering the cylindrical body diameters, as the tension in the infeed and outfeed of the nips can be controlled.

The cylindrical body also could be used to change a signature cut-off in a folder and altering a path length of a folding cylinder as a function of the varying step.

What is claimed is:

1. A printing device comprising:

a first variable-diameter cylindrical rotating body comprising a plurality of first tapered elements; and a plurality of second tapered elements interacting with the first tapered elements and movable axially with respect to the first tapered elements, the first and second tapered elements defining an outer surface of the body, the outer surface having an effective diameter variable as a function of axial movement between the first and second tapered elements; and a second rotating body forming a nip with the first rotating body, a first motor for driving the first rotating body, a second motor for driving the second rotating body, and a torque controller for distributing torque between the first and second motors as a function of an effective diameter of the first rotating body.

2. The device as recited in claim 1 wherein the body is one of a plate cylinder, a blanket cylinder, and an ink form roller of a printing press.

3. The device as recited in claim 1 wherein the variable effective diameter remains the same over an effective width of the first rotating body.

4. The device as recited in claim 1 wherein the second rotating body is a variable-diameter rotating body.

5. The device as recited in claim 1 wherein the first rotating body is one of an ink form roll, plate cylinder and a blanket cylinder of an offset lithographic printing press.

6. The device as recited in claim 1 wherein the variable-diameter cylinder is laterally registrable.

7. A method for altering an effective diameter of a cylindrically-shaped body comprising the steps of:

varying an effective diameter of the body by moving a plurality of first tapered elements axially between interacting second tapered elements, the first and second tapered elements defining an outer surface of the body; and controlling at least one of microslip in a nip, a speed of a web, a first tension in a span between two nips, a second tension in an out-feed and a third tension in an infeed as a function of the varying step.

8. The method as recited in claim 7 further comprising rotating the body.

9. The method as recited in claim 7 wherein the body is part of a printing device.

10. The method as recited in claim 7 further including altering a torque of a drive motor for the body by varying the diameter.

11. The method as recited in claim 7 further including altering ink delivery as a function of the effective diameter.

12. The method as recited in claim 7 further including securing a printing form by altering the effective diameter.

13. The method as recited in claim 7 wherein the microslip in the nip is controlled.

14. The method as recited in claim 7 further including at least one of moving the rotating body into or out of contact with another object and adjusting the contact pressure between the rotating body and the other object as a function of the varying step.

15. The method as recited in claim 7 wherein the speed of a web is controlled.

16. The method as recited in claim 7 wherein the first tension in the span between two nips is controlled.

17. The method as recited in claim 7 wherein the second tension in the out-feed is controlled.

18. The method as recited in claim 7 wherein the third tension in the infeed is controlled.

19. The method as recited in claim 7 further comprising securing a printing blanket by altering the effective diameter.

20. The method as recited in claim 7 further comprising altering a lateral register of the body by moving the first and second tapered elements axially in a same direction.

21. A method for altering an effective diameter of a cylindrically-shaped body comprising the steps of:

varying an effective diameter of the body by moving a plurality of first tapered elements axially between interacting second tapered elements, the first and second tapered elements defining an outer surface of the body; and at least one of changing a signature cut-off in a folder and altering a path length of a folding cylinder as a function of the varying step.

22. A method for altering an effective diameter of a cylindrically-shaped body in a printing press comprising the steps of:

varying an effective diameter of the body by moving a plurality of first tapered elements axially between interacting second tapered elements, the first and second tapered elements defining an outer surface of the body; and laterally registering the body by laterally moving both the first and second tapered elements in a same direction.

23. A method for altering an effective diameter of a cylindrically-shaped body in a printing press comprising the steps of:

varying an effective diameter of the body by moving a plurality of first tapered elements axially between interacting second tapered elements, the first and second tapered elements defining an outer surface of the body; and securing a printing blanket to the body by expanding the effective diameter of the body to contact the printing blanket.

24. A method for altering an effective diameter of a rotating cylindrically-shaped body in a printing press comprising the steps of:

varying an effective diameter of the body by moving a plurality of first tapered elements axially between interacting second tapered elements, the first and second tapered elements defining an outer surface of the body; and securing a printing form to the body by expanding the effective diameter of the body to contact the printing form.

* * * * *